United States Patent [19]

Wickstrom et al.

[11] 4,263,124

[45] Apr. 21, 1981

[54] PROCESS FOR MINIMIZING SOLIDS CONTAMINATION OF LIQUIDS FROM COAL PYROLYSIS

[75] Inventors: Gary H. Wickstrom, Yorba Linda; Everett W. Knell, Los Alamitos; Benjamin W. Shaw, Costa Mesa; Yue G. Wang, West Covina, all of Calif.

[73] Assignee: Occidental Petroleum Corporation, Los Angeles, Calif.

[21] Appl. No.: 45,782

[22] Filed: Jun. 5, 1979

Related U.S. Application Data

[63] Continuation of Ser. No. 853,528, Nov. 21, 1977, abandoned, which is a continuation of Ser. No. 700,003, Jun. 25, 1976, abandoned.

[51] Int. Cl.[3] ..... C10G 1/00; C10B 47/00

[52] U.S. Cl. ..... 208/8 R; 208/11 R; 201/4; 201/8; 201/12; 201/16

[58] Field of Search ..... 208/8 R, 11 R; 201/8, 201/12, 4, 16

[56] References Cited

U.S. PATENT DOCUMENTS

| | | | |
|---|---|---|---|
| 2,480,670 | 8/1949 | Peck | 208/11 R |
| 2,677,650 | 5/1954 | Welinsky | 201/12 |
| 2,723,951 | 11/1955 | Minet | 201/4 |
| 3,167,494 | 1/1965 | Crawford | 208/11 R |
| 3,597,347 | 8/1971 | Ellington | 208/11 R |
| 3,784,462 | 1/1974 | Frick | 208/11 R |
| 3,839,186 | 10/1974 | Berger | 208/8 |
| 4,064,018 | 12/1977 | Choi | 201/12 |

*Primary Examiner*—Delbert E. Gantz
*Assistant Examiner*—William G. Wright
*Attorney, Agent, or Firm*—Christie, Parker & Hale

[57] ABSTRACT

In a continuous process for recovery of liquid hydrocarbons from a solid carbonaceous material by pyrolysis of the carbonaceous material in the presence of a particulate source of heat, particulate contamination of the liquid hydrocarbons is minimized. This is accomplished by removing fines from the solid carbonaceous material feed stream before pyrolysis, removing fines from the particulate source of heat before combining it with the carbonaceous material to effect pyrolysis of the carbonaceous material, and providing a coarse fraction of reduced fines content of the carbon containing solid residue resulting from the pyrolysis of the carbonaceous material before oxidizing carbon in the carbon containing solid residue to form the particulate source of heat.

34 Claims, 2 Drawing Figures

PROCESS FOR MINIMIZING SOLIDS CONTAMINATION OF LIQUIDS FROM COAL PYROLYSIS

The Government has rights in or in respect of this invention pursuant to Contract No. E(49-18)-2244 awarded by the U.S. Energy Research and Development Administration.

CROSS REFERENCE TO RELATED APPLICATIONS

This is a continuation of application Ser. No. 853,528, filed Nov. 21, 1977 now abandoned which is a continuation of application Ser. No. 700,003 June 25, 1976, now abandoned.

BACKGROUND OF THE INVENTION

Fluid fossil fuels such as oil and natural gas are becoming scarce as these fuels are consumed by a world whose population is continually growing. Thus much attention is being directed towards producing liquid hydrocarbons from solid carbonaceous materials such as coal which is available in abundant quantities in some countries such as the United States.

In U.S. Pat. No. 3,936,233 Sass et al disclose a process for recovery of liquid hydrocarbons from comminuted coal by pyrolyzing the comminuted coal in the presence of a particulate source of heat. The pyrolysis of the coal yields pyrolytic vapors containing volatilized hydrocarbons and char. In this process, char is separated from the pyrolytic vapors and the particulate source of heat for pyrolysis of incoming coal is furnished by oxidation of separated char.

Although processes such as Sass' process are useful for achieving high yields of liquid hydrocarbons from coal, the liquid hydrocarbons resulting from condensation of the pyrolytic vapors can be contaminated by particulate matter. This reduces the economic value of the liquid hydrocarbons. This particulate matter, which is primarily char, is the result of incomplete separation of char fines from the pyrolytic vapors. Char fines result from pyrolysis of coal fines produced by comminution of the coal, reduction of the size of char particles due to oxidation, and attrition of char particles during processing.

Char fines can be present in the liquid hydrocarbons because devices for separating char from pyrolytic vapors are relatively inefficient for fines, especially fines less than about 10 microns in diameter. Once in the condensed hydrocarbons, the char is difficult to remove because the hydrocarbons typically are highly viscous and a large portion of the fines are less than about 10 microns in diameter, thus making their removal by conventional solids separation techniques such as filtration and centrifugation from the hydrocarbons very difficult.

Thus there is a need for a process for recovery of liquid hydrocarbons from solid carbonaceous materials such as coal in which the fines content of the solids introduced into the pyrolysis reactor is minimized to minimize contamination of the liquid hydrocarbons by solids.

SUMMARY OF THE INVENTION

This invention is for a continuous process for recovery of liquid hydrocarbons from solid carbonaceous materials with the above features, where a feed stream containing solid carbonaceous material particles having a diameter less than a predetermined diameter in the range from about 75 to about 1000 microns in diameter is prepared by initially comminuting the solid carbonaceous material. To achieve particles of optimum particle size, preferably the carbonaceous material is comminuted so that a portion of the carbonaceous material is larger than the predetermined size. This minimizes fines generation during the comminution step and possible contamination of the liquid products of pyrolysis of the carbonaceous material. Then a substantial portion of the oversized particles larger than the predetermined size are separated from the comminuted carbonaceous material, and then recycled for further comminution. At least 10%, and preferably from about 20 to about 50% by weight of fines less than about 10 microns in diameter are separated from the comminuted carbonaceous material before and/or after separating out the oversize particles.

When processing an agglomerative coal, preferably the coal feed stream is substantially free of particles greater than about 250 microns in diameter so that the particles can be heated rapidly to a temperature above which they will adhere to the reactor walls before they strike the pyrolysis reactor walls. This is effected by comminuting the coal so that a portion of the coal is larger than 250 microns in diameter, separating oversize particles larger than 250 microns from the comminuted coal, and then recycling the oversize particles for further comminution. The sub 250 micron particles are delivered for processing.

The solid carbonaceous material particles are subjected to pyrolysis by introducing the particles with a particulate heat source into a pyrolysis zone. The pyrolysis of the carbonaceous material yields a pyrolysis product stream containing as solids, particulate source of heat and a carbon containing residue of pyrolysis of the carbonaceous material particles, and a vapor mixture comprising volatilized hydrocarbons. A coarse fraction of solids are separated from the vapor mixture. The coarse fraction contains less than 90%, and preferably from about 50 to about 80% by weight of fines less than 10 microns in diameter in the pyrolysis product stream. Then the bulk of the solids remaining in the vapor mixture after removal of the coarse fraction is removed from the vapor mixture. Carbon in at least a portion of the coarse fraction of the carbon containing solid residue is subjected to at least partial oxidation in the presence of a source of oxygen, such as air, to heat the solids to form the particulate source of heat for feed to the pyrolysis zone.

A fines fraction is removed from the hot solids prior to feeding the hot solids to the pyrolysis reaction zone to prevent the fines contaminating the hydrocarbon products of the process. The fines fraction comprises at least about 10%, and preferably from about 20 to about 50% by weight of fines less than 10 microns in diameter of the hot solids.

Values are separated from the vapor mixture by condensing volatilized hydrocarbons therefrom.

Preferably the mass of the fines removed from the particulate source of heat and the fine solids separated from the pyrolysis product stream after removal of the coarse fraction, in combination, are about equal to the mass of the carbon containing solid residue not oxidized to form the particulate source of heat.

This process minimizes particulate contamination of the liquid hydrocarbons resulting from pyrolysis of solid carbonaceous materials because of four novel features. First, in the preparation operation the production of fines is minimized in the comminution step by initially comminuting the carbonaceous material so that a portion of the particles formed is larger than a predetermined size. Second, fines produced during the comminution are separated from the comminuted carbonaceous material. Third, in the pyrolysis operation, a coarse fraction with reduced fines content is provided for oxidation to prepare the particulate source of heat. And fourth, also in the pyrolysis operation, fines in the particulate source of heat are removed before feeding the particulate source of heat to the pyrolysis reaction zone. These four features may be used separately or jointly to reduce solid contamination of the liquid hydrocarbons.

The effect of minimizing fines production in the preparation operation and selectively removing fines from the comminuted coal and the carbon containing solids, both before and after oxidation, in the pyrolysis operation is to prevent build-ups of fines in the circulating inventory of particulate source of heat. This minimizes the loss of fines with hydrocarbon products of pyrolysis and the resultant contamination of the hydrocarbon products with solids.

These and other features, aspects and advantages of the present invention will become more apparent in the accompanying drawings, detailed description of the invention and appended claims.

DRAWINGS

FIG. 1 schematically illustrates an overall process embodying features of this invention; and FIG. 2 illustrates details of a preparation operation and a pyrolysis operation embodying features of this invention.

DETAILED DESCRIPTION

According to the present invention there is provided a system for economical recovery of values from solid carbonaceous materials with minimum solids contamination of the liquid hydrocarbon product of pyrolysis. The system consists of the following major operations: a preparation operation, a pyrolysis operation, a recovery operation, and a gas cleanup operation. First, definitions are presented followed by a description in general terms of the overall operations. Next, a coal preparation and coal pyrolysis operation embodying features of the invention are detailed.

A. DEFINITIONS

This section presents definitions useful in understanding the process of the present invention.

As used herein and in conjunction with the processing operations described, the term "comminution" refers to any physical act of size reduction, including, but not limited to chopping, crushing, and grinding by suitable machinery.

When a solid carbonaceous material is pyrolyzed there is formed a mixture of a carbon containing solid residue and a vapor mixture. When coal is pyrolyzed the solid residue is char. "Char" is a combustible carbonaceous residue remaining after thermal distillation of volatiles from coal with attendant thermal cracking of the volatilized hydrocarbons. The vapor mixture contains "volatilized hydrocarbons", water, and nonhydrocarbon gases such as carbon dioxide and hydrogen sulfide.

By the term "volatilized hydrocarbons" there is meant the hydrocarbon containing gases produced by pyrolysis of a solid carbonaceous material. In general these consist of condensible hydrocarbons in vapor or aerosol form which may be recovered by simply contacting the volatilized hydrocarbons with condensation means, and noncondensible gases or "product gas" such as methane and other hydrocarbon gases which are not recoverable by ordinary condensation at ambient temperature and pressure.

A transport gas typically is used to carry carbonaceous material particles to a pyrolysis reactor. By a "nondeleteriously reactive" carrier or transport gas there is meant a gas stream which is essentially free of free oxygen, although the constituents of the gas may react with pyrolysis products to upgrade their value. To be avoided are constituents which degrade pyrolysis products.

B. OVERALL OPERATIONS

Figure 1:
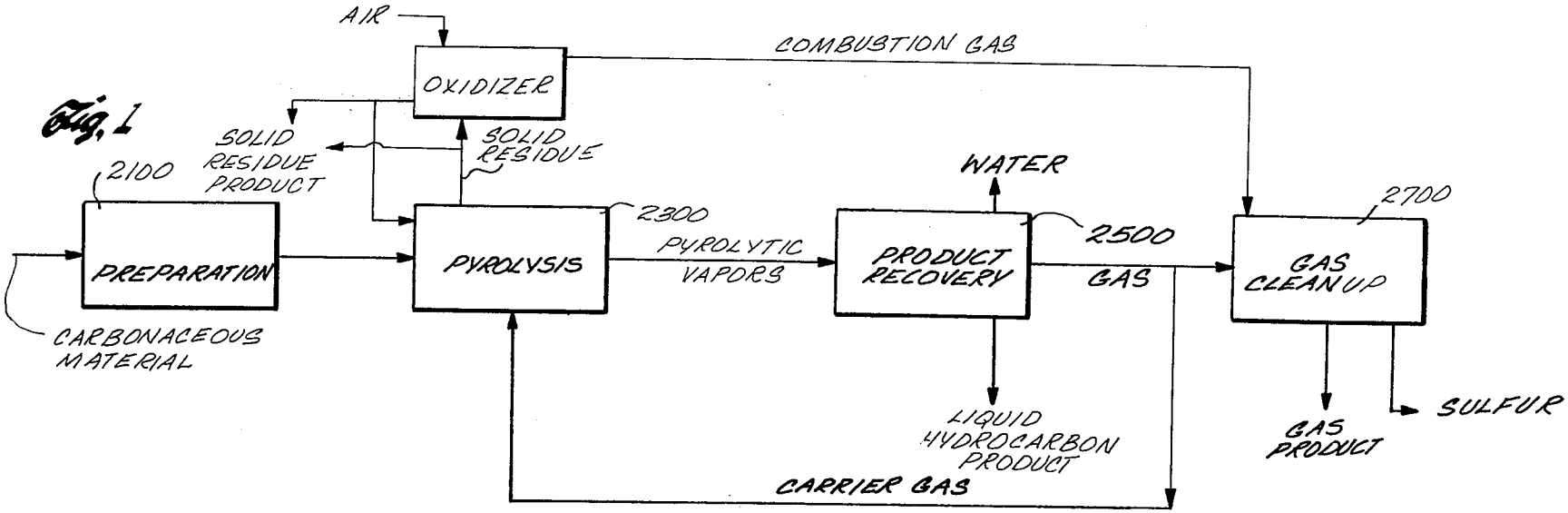

FIG. 1 schematically shows the overall process for recovery of values from solid carbonaceous materials. The solid carbonaceous materials from which values may be recovered in accordance with this invention include uintaite, tar sands, oil shale, the organic portion of solid waste, particularly coal, in which terms this invention is described, and more particularly agglomerative coals, and the like, as well as mixtures thereof. All the various types of coal or coal like substances can be pyrolyzed. These include anthracite coal, bituminous coal, subbituminous coal, lignite, peat, and the like. The solid carbonaceous material is introduced to a preparation operation 2100 (FIG. 2) where the bulk of the carbonaceous material is initially comminuted to a particle size less than about 1000 microns, and in the case of an agglomerative coal, preferably to less than about 250 microns. Production of fines less than about 10 microns is minimized, and fines less than about 10 microns in diameter can be separated from the comminuted carbonaceous material to leave a coarse fraction as the feed stream for pyrolysis.

The carbonaceous material is preferably at least partially dried to avoid the expenditure of heat energy for heating and vaporizing water in the pyrolysis zone.

Next, in a pyrolysis operation 2300 (FIG. 2) the feed stream, a carrier gas which is nondeieteriously reactive with respect to pyrolysis products, and a particulate heat source are combined in a pyrolysis zone. The heat source employed is the solid product resulting from pyrolysis of the carbonaceous material, such as char or coke, or, in the instance of municipal solid waste, the glass-like inorganic residue resulting from the complete combustion of the solid residue of pyrolysis. The pyrolysis zone is maintained at a temperature sufficient to produce by pyrolysis of the carbonaceous material a pyrolysis product stream containing as solids, particulate source of heat and a carbon containing solid residue, and a vapor mixture comprising volatilized hydrocarbons by the flow of the particulate heat source therethrough. The solids are separated from the pyrolytic vapor and at least a portion of the carbon containing solid residue in the separated solids is subjected to at least partial oxidation in the presence of a source of oxygen to form gaseous combustion products and the particulate source of heat for the pyrolysis operation. Excess carbon containing residue beyond what is needed to form the particulate source of heat is withdrawn as product.

In a product recovery operation 2500 (FIG. 1) values are separated from the pyrolysis product stream. This is effected by condensing volatilized hydrocarbons from the vapor mixture.

Gases not condensed in the product recovery operation are cleaned up in the gas cleanup operation 2700 (FIG. 1) where sulfur compounds are scrubbed from the gas. A portion of the gas, either before or after cleaning, can be recycled to the pyrolysis operation as a carrier gas. A portion containing uncondensible hydrocarbons can be recovered as a valuable gas product stream.

C. PREPARATION

Figure 2:
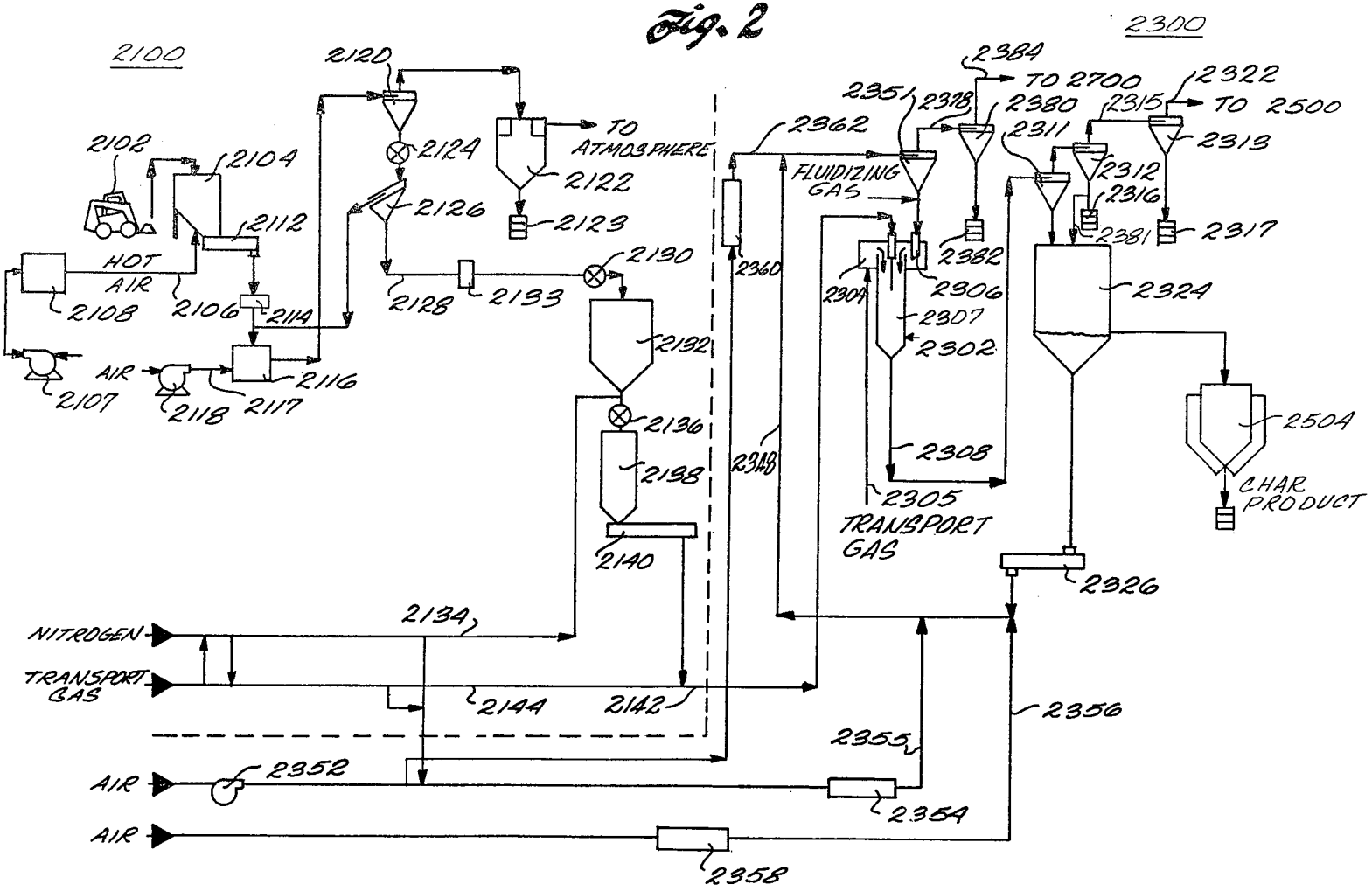

To the left of the dotted line in FIG. 2 the details of coal preparation operation 2100 are shown. The purpose of the preparation operation 2100 is to provide a coal feed for pyrolysis within a predetermined particle size range.

There is provided a coal storage and transfer area where coal transport units 2102 are continuously employed to deposit coal for processing for the recovery of the values contained therein. The coal is dumped into a raw coal bin 2104. The coal is at least partially dried in the bin 2104 by a flue gas stream from the gas cleanup operation 2700 or by a hot air stream 2106 obtained by blowing air with a blower 2107 through a heater 2108.

The coal is dumped from the bin 2104 onto a conveyor 2112 which carries the coal to a crusher 2114 and thence to a pulverized stage 2116. The crusher and pulverizer in combination comminute the feed coal to a diameter less than a predetermined size in the range of from about 75 to about 1000 microns to present a large surface to volume ratio to obtain rapid heating of the coal in the pyrolysis zone. Two comminution stages can be required to comminute the coal. For an agglomerative coal, preferably the predetermined size is about 250 microns because agglomerative coals are well known to plasticize and agglutinate at relatively low temperature, i.e., 400° to 850° F. If the agglomerative coal is pyrolyzed in the absence of free oxygen and the agglomerative coal is not subjected to oxidative treatment before pyrolysis, the coal should be heated to a temperature above the temperature at which it is "tacky" before it strikes the wall of a pyrolysis reactor to prevent caking on the reactor walls. Since the rate at which a coal particle can be heated increases as particle size decreases, it is important that an agglomerative coal be comminuted to 250 microns or less, depending on the size and configuration of the pyrolysis reactor, so that substantially all the coal particles are not tacky by the time the coal particles strike a reactor wall.

The pulverizer preferably is operated so that a portion of the coal is comminuted to a size above the predetermined size in a single pass through the pulverizer to reduce fines formation and reduce energy consumption during comminution. For example when the upper limit on the particle size of the coal is 75 microns, preferably from about 70 to about 99% of the coal and more preferably from about 80 to about 95%, is communited to a size less than about 75 microns. It has been found that if all the coal is reduced to a size less than the upper limit in a single pass through the pulverizer 2116, too many fines are produced, which subsequently must be withdrawn to keep particulate matter out of the hydrocarbon products of pyrolysis. This occurs because a disproportionately greater power input is required to reduce the final few percent of particles to the predetermined size. This power is consumed for the most part in commuting particles already under the size limit to even smaller particles. This is, the power is consumed in generating fines. Generally, the percent of coal particles to remain above the predetermined size is inversely proportional to the predetermined size for a fixed machine and power input.

It is important to minimize coal fines in the comminuted coal because char fines, which have a tendency to be carried into and contaminate the liquid hydrocarbon products of pyrolysis, result from pyrolysis of coal fines.

Therefore, the coal is transported from the pulverizer 2116 by a flue gas stream or any air stream 2117 produced by compressor 2118 to a pulverized coal feed cyclone separator 2120 where at least about 10, and preferably at least about 20% by weight of fines are carried overhead by the air stream to a bag house 2122 where the fines are separated from the air which is vented into the atmosphere. The fines are collected in a container 2123 and can be used as boiler feed.

As used herein, including in the claims, the term "fines" means particles less than 10 microns in diameter.

Ideally all of the fines are separated from the comminuted coal. However, existing solids separation equipment does not give a perfect cut, i.e., along with the fines some coarse coal particles are removed. Therefore, if more than about 50% of the fines are separated from the comminuted coal, too many of the coarser particles which are satisfactory for feed to the pyrolysis operation are also removed. This would adversely affect the yields of the process. Therefore, preferably, only up to about 50% of the fines in the comminuted coal are separated from the comminuted coal.

The larger coal particles drop from the cyclone 2120 via a rotary lock valve 2124 into a mechanical classifier such as vibrating screen 2126. The rotary lock valve helps prevent the air in the coal comminution system from entering the comminuted coal storage area and possibly the pyrolysis reactor where an explosion could occur. The screen 2126 separates oversized coal particles greater than the predetermined size from the remainder of the comminuted coal. The oversized coal is recycled to the pulverizer 2116. The remainder of the coal, the bulk of which has a particle size less than the predetermined size and greater than 10 microns, drops via line 2128 into a rotary valve 2130 which carries the coal to a pulverized coal storage bin 2132. A sample point 2133 can be positioned in line 2128 to monitor the particle size distribution of the pulverized coal so that the operation of the pulverizer 2116 can be adjusted to prevent fines from entering the coal storage bin.

Alternatively, fines can be removed from the comminuted coal feed stream after separating out the oversized particles. Also, fines can be removed by passing the comminuted coal to a cyclone separation zone comprising two cyclones in series. The bulk of the coal feed stream is separated from a fines fraction of the coal feed stream in the first cyclone. The fines fraction contains at least 10%, and preferably from about 20 to about 50% of the comminuted coal fines. The stream separated in the first cyclone is for introduction to the pyrolysis zone. The fines fraction is recovered in the second cyclone.

The pulverized coal storage bin 2132 is maintained under an oxygen free atmosphere by bleeding in an oxygen free gas such as nitrogen or transport gas via line 2134 to prevent oxidation of the coal which has a deleterious effect on yields from the process and to prevent oxygen from leaking into the pyrolysis reaction zone. From the pulverized coal storage bin 2132 the coal is transported via a rotary valve 2136 into a surge bin 2138 which is utilized to prevent upsets in the coal preparation operation from affecting the pyrolysis operation. The surge bin 2138 also is maintained under an oxygen free atmosphere. Preferably during the entire coal preparation operation the coal is not exposed to temperatures above about 300° F. to prevent agglomeration of the coal particles when an agglomerative type coal is being processed.

The comminuted dried coal in the surge bin 2138 is fed at a desired rate by a screw feeder 2140 into the reactor feed transport line 2142. The coal feed is carried by a transport gas stream 2144 to the pyrolysis reactor 2302 in the pyrolysis operation. The transport gas is nondeleteriously reactive with respect to pyrolysis products. It is preferred that the transport gas be a portion of the gas generated in the pyrolysis operation 2500. Other nondeleteriously reactive gases such as nitrogen may also be used.

D. PYROLYSIS

To the right of and below the dotted line in FIG. 2, the pyrolysis operation 2300 is depicted in detail. In this operation the comminuted coal is converted to form char and volatilized hydrocarbons.

With reference to FIG. 2, the comminuted dried coal with its transport gas is conveyed via line 2142 into the mixing region 2304 of a pyrolysis reactor such as the pyrolysis reactor 2302. Simultaneously with the introduction of the coal into the reactor, there is introduced a particulate heat source along with its transport gas stream 2305 via a fluidized duct 2306. This particulate heat source is a material capable of transferring heat to the coal to cause its pyrolysis into volatilized hydrocarbons and char. The preferred heat source is char obtained from the devolatilization of coal in the pyrolysis reactor. The transport gas 2305 preferably is nondeleteriously reactive with respect to pyrolysis products.

The particulate source of heat serves to prevent agglomeration and to provide at least a portion of the heat required for pyrolysis. The selection of the mass ratio of the hot particulate char to the coal particles depends upon the heat required to effect pyrolysis, the tendency of the coal particles to agglomerate, and the amount of the heat of pyrolysis which is supplied by the carrier gas. The temperature, flow rate, and residence time in the reactor depend upon the particular system undergoing pyrolysis.

The reactor 2302 is operated, depending upon the temperature and the nature of the particulate heat source, at a temperature of from between about 600° F. and the introduction temperature of the particulate heat source. Pyrolysis generally occurs between about 600° and 2000° F. Temperatures from about 600° to about 1400° F., and preferably from about 900° to about 1400° F., are employed for liquifaction, with higher temperatures employed for gasification. The reactor temperature is sustained by the particulate heat source.

The coal feed stream 2348, char from line 2306, and the nondeleteriously reactive carrier gas stream 2304 are combined in the mixing zone 2304 to form a pyrolysis feed stream which is then reacted in the pyrolysis reactor zone 2302 to yield a pyrolysis product stream 2308 containing char and a vapor mixture, where the vapor mixture contains volatilized hydrocarbons, carrier gas fed to the pyrolysis reaction zone and products of pyrolysis such as carbon dioxide, water vapor, and hydrogen sulfide.

The solids in the pyrolysis reactor product stream 2308 is separated from the vapor in three cyclones 2311, 2312, 2313, in series. The primary cyclone separator 2311 is a medium efficiency separator which removes most of the char particulates from the gas stream. The overhead stream 2315 from the primary cyclone 2311 contains at least about 10% and preferably from about 20 to about 50% by weight of the char particle fines. The preferred range is a good balance between withdrawing enough fines to minimize the amount of circulating fines in the char oxidation loop and withdrawing so many fines that more of the char is withdrawn than is produced by pyrolysis of the coal feed.

Smaller particles are separated in the high efficiency secondary 2312 and tertiary 2313 reactor cyclones, and collected in bins 2316 and 2317, respectively. The char in bin 2316 is introduced to the char oxidation loop, or if it contains many fines, it is sold as char product. The char in bin 2317 is sold as char product. By removing the char particles separated in the tertiary cyclone stage 2313, and where necessary the char separated in the secondary cyclone 2312, from the circulating char system used to heat the reaction zone 2302, the amount of circulating fines in the char system is decreased. This is important in keeping char fines from going overhead in the tertiary reactor cyclone 2313 and contaminating the liquid hydrocarbon product.

The overhead stream 2322 from the tertiary cyclone, a gaseous pyrolysis product stream with transport gas, is sent to the product recovery operation 2500.

The char separated by the primary reactor cyclone 2311 drops into a char surge bin 2324 to be pneumatically carried through the char combustion loop.

Preferably the char collected in bins 2316 and 2317, along with particulate source of heat fines collected in bin 2382 as described below, represents the net production of solids of the process. Thus as coal is pyrolyzed to produce char, smaller particles are selectively withdrawn from the char inventory while larger char particles are left in the char combustion loop to form the particulate source of heat. This helps prevent contamination of the hydrocarbon product with fines carried over from the tertiary reactor cyclone 2313. If more char passes overhead from the primary reactor cyclone 2311 than is produced during pyrolysis of the coal, a portion of the char separated by the secondary cyclone can be diverted via line 2381 into the char surge bin 2324.

At least a portion of the heat required for the pyrolysis operation is obtained by subjecting at least a portion of the separated char to at least partial oxidation in the presence of a source of oxygen such as air. The screw feeder 2326 conveys the char at a controlled feed rate into a transport line 2348 in which the char is carried to a cyclone combustion stage 2351 by a hot air stream mixed with an oxygen free gas such as nitrogen or a transport gas obtained from the noncondensible fraction of the volatilized hydrocarbons resulting from the pyrolysis of the coal. The oxygen free gas is added to the hot air to provide sufficient gas velocity to convey the char. The hot air stream is obtained from a compressor 2352 which blows air through an air heater 2354 and into the transport line 2348 via line 2355. For start-up purposes, hot combustion gas is added through line 2356 to the combustion char to provide sufficient heat for pyrolysis. The hot combustion gas is obtained by completely burning natural gas in the presence of air in a gas generator 2358.

The oxygen in the air reacts exothermically with the carbon in the char to produce combustion gas containing carbon monoxide. Only about half the oxygen required for oxidizing char to produce sufficient heat for pyrolysis is fed through line 2355. The rest of the oxygen is obtained by taking some of the air compressed by a compressor 2352, and heating the compressed air in a heater 2360. The heated air is fed via line 2362 to the inlet of the cyclone combustion stage 2351, where it is combined with the partially oxidized char.

This method of introducing the oxygen to the char in two stages where the balance of the oxygen is introduced at the inlet of a cyclone serves to minimize the production of carbon monoxide in the oxidation of the char. When char is burned where there is less than stoichiometric amounts of air and/or the residence time is long, then the reaction product gases tend to contain more carbon monoxide than carbon dioxide. This is undesirable because more valuable char has to be burned to achieve desired char temperatures than if carbon dioxide were the only product. In the processes shown in FIG. 2, the char is burned in cyclone combustion stages 2351, where it is separated from the gases in a very short time, thus selectively maximizing carbon dioxide production. Another advantage of using a cyclone vessel for reacting the char with an oxygen containing gas is that combustion of the char and separation of the combustion gases from the hot char are accomplished in the same vessel, the cyclone. This reduces capital and operating costs. Also, consumption of char is reduced at a given temperature rise. In addition, smaller char particles, which are less valuable than the larger char particles, are burned preferentially because of the fast separation of the large particles in the cyclone and because of their high specific surface areas.

The particulate source of heat is separated from the transport gas, nonreactive components of the oxygen source, and combustion gas in a cyclone separation stage comprising the cyclone combustion-separation stage 2351 and a char cyclone 2380. The bulk of the solids are separated as a coarse fraction in the cyclone combustion-separation stage simultaneously with the oxidation of the char. The gaseous overhead stream 2378 from the cyclone combustion-separation stage 2351 flows into the char cyclone 2380 where char fines and any ash resulting from the complete oxidation of char are separated and dropped into a container 2382 for sale as boiler feed.

At least about 10% and preferably at least about 20% by weight of char fines less than 10 microns in diameter pass as part of the overhead 2378 from the cyclone combustion-separation stage 2351 to the cyclone 2380. However, not more than about 50% of the fines are in the overhead because at separation rates of greater than 50% too many coarse particles pass overhead from the cyclone combustion-separation zone and are lost from the coarse fraction and thus are not available for feed to the pyrolysis reactor.

Because a portion of the char fines are not sent to the reaction zone, the inventory of fines in the char loop is minimized and there is less chance of char particles going overhead from the tertiary reactor cyclone 2313 and contaminating the hydrocarbon product. The gas 2384 discharged from the secondary char cyclone 2382 is vented to the gas cleanup operation 2700 for purification before it is vented to the atmosphere.

Although in the process shown in FIG. 2 the step of producing hot char by oxidation of char and the step of separating fines from the hot char to yield the particulate source of heat are performed simultaneously in a cyclone combustion-separation stage, these steps can be performed sequentially in a combustion stage such as a tubular reactor followed by a separation zone such as a cyclone separator.

The char recovered in the cyclone combustion-separation stage 2351 is introduced to the mixing zone 2302 through a fluidized duct 2306. A fluidized duct is used to ensure a steady flow of hot char into the annular mixing zone 2304.

Surplus char produced by the pyrolysis reaction is withdrawn from the char surge bin 2324 and sent to the product char bin 2504.

The following Control and Example demonstrate how the method of this invention significantly reduces the level of particulates, and especially fines less than 10 microns in diameter, in the pyrolytic vapors.

CONTROL

An agglomerative coal is treated using the process shown in FIG. 2 and described above, with the following modifications:

(1) In the pulverizer 2116 all the coal is comminuted to a particle size and less than about 75 microns;
(2) The mechanical classifier 2126 is eliminated and no coal is cycled to the pulverizer 2116;
(3) Char separated by the tertiary reactor cyclone 2313 is cycled back to the char surge bin 2324;
(4) Char separated in the char cyclone 2380 is introduced to the pyrolysis reactor 2302.

Coal is fed at a rate of 250 pounds per hour to the pyrolysis reactor 2302 along with 2500 pounds per hour of hot char. Table I shows the particle size distribution of solids in these two streams as well as the particle size distribution and solids rate of the pyrolytic vapor stream 2322 to the recovery operation.

EXAMPLE

The same coal and char feed rates used for the Control is used for this Example. The process shown in FIG. 2 is used without modification.

Table II shows the particle size distribution of the coal feed and char feed to the reactor streams, as well as the solids rate and particle size distribution of the solids in the pyrolytic vapor stream 2322 to recovery.

Comparison of the results shown in Table I to the results in Table II shows that the process of this invention reduces the amount of solids in the pyrolytic vapor by over 85%, i.e., from 1.05 pounds per hour down to 0.15 pounds per hour. Also, the process of this invention significantly reduces the level of particles smaller than 10 microns in the pyrolytic vapors. This is important because it is these particles which are the most difficult to remove from the hydrocarbon products condensed from the pyrolytic vapors. In the Control there is about 0.6 pound per hour of particles smaller than 10 microns in the pyrolytic vapor stream while with the process of this invention there is less than 0.02 pound per hour of the difficult to remove fines in the pyrolytic vapor.

Although this invention has been described in considerable detail with reference to certain embodiments thereof, it will be understood that variations and modifications can be effected within the spirit and scope of the invention as described above and defined in the appended claims.

TABLE I

| Stream | Stream Number | Solids Rate (lb/hr) | Particle Size of Solids 75μ | (Weight % Smaller than Size Indicated) 35μ | 10μ |
|---|---|---|---|---|---|
| Coal Feed to Reactor | 2142 | 250 | 100 | 84 | 26.4 |
| Char to Reactor | 2306 | 2500 | 100 | 9 | 0.7 |
| Pyrolytic Vapors to Recovery | 2322 | 1.05 | 100 | 100 | 58 |

TABLE II

| Stream | Stream Number | Solids Rate (lb/hr) | Particle Size of Solids 75μ | (Weight % Smaller than Size Indicated) 35μ | 10μ |
|---|---|---|---|---|---|
| Coal Feed to Reactor | 2142 | 250 | 100 | 35 | 0.7 |
| Char to Reactor | 2306 | 2500 | 100 | 4 | 0.0 |
| Pyrolytic Vapors to Recovery | 2322 | 0.15 | 100 | 100 | 10.5 |

What is claimed is:

1. A continuous process for recovery of values contained in a solid carbonaceous material by pyrolysis which comprises the steps of:

(a) preparing the solid carbonaceous material for pyrolysis by forming the feed stream comprising solid carbonaceous material particles, by forming the solid carbonaceous material particles having a diameter less than a predetermined size, said predetermined size being from about 75 to about 1000 microns, by the steps of:

(i) initially comminuting the solid carbonaceous material in a comminution stage so that a portion of the comminuted solid carbonaceous material is larger than the predetermined size in diameter to minimize generation of fines;

(ii) separating oversize solid carbonaceous material particles which are larger than the predetermined size from the comminuted solid carbonaceous material for forming an oversize fraction and a feed stream for pyrolysis;

(iii) recycling the separated oversize fraction to the comminution stage for further comminution; and (iv) separating from the feed stream at least 10% by weight of fines less than about 10 microns in diameter prior to or following separation of the oversize fraction;

(b) subjecting the feed stream, having at least 10% by weight of the fines less than about 10 microns in diameter removed, to pyrolysis by introducing the feed stream and a particulate heat source into a pyrolysis zone maintained at a temperature, by the flow of the particulate heat source through the pyrolysis zone, sufficient to pyrolyze the carbonaceous material particles to form a pyrolysis product stream containing as solids, at least a portion of the particulate heat source and a carbon containing residue of the solid carbonaceous material particles, and a pyrolytic vapor mixture comprising volatilized hydrocarbons;

(c) passing the pyrolysis product stream to a separation zone to separate solids from the pyrolytic vapor mixture and separating the solids from the pyrolytic vapor mixture;

(d) subjecting at least a portion of the separated solids to at least partial oxidation in the presence of a source of oxygen to form the particulate heat source, and recycling the thusly formed particulate heat source to the pyrolysis zone; and (e) separating and recovering values from the pyrolytic vapor mixture by condensing hydrocarbons therefrom.

2. A process as claimed in claim 1 in which from about 20 to about 50% by weight of fines less than about 10 microns in diameter are removed from the comminuted solid carbonaceous material.

3. A process as claimed in claim 1 wherein the step of separating solids from the pyrolytic vapor mixture comprises separating a coarse fraction containing less than about 90% by weight of the fines less than about 10 microns in diameter in the pyrolysis product stream.

4. A process as claimed in claim 1 wherein the step of separating solids from the pyrolytic vapor mixture comprises separating a coarse fraction containing from about 50 to about 90% by weight of the fines less than about 10 microns in diameter in the pyrolytic vapor mixture.

5. A process as claimed in claim 1 comprising the additional step of removing from the particulate heat source a fines fraction comprising at least about 10% and up to about 50% by weight of the fines less than about 10 microns in diameter in the particulate heat source prior to introducing the particulate heat source to the pyrolysis zone.

6. A process as claimed in claim 1 comprising the additional step of removing from the particulate heat source a fines fraction containing from about 20 to about 50% by weight of the fines less than about 10 microns in diameter in the particulate heat source prior to introducing the particulate heat source to the pyrolysis zone.

7. A process as claimed in claim 1 wherein the solid carbonaceous material is an agglomerative coal and the predetermined size is about 250 microns.

8. A process as claimed in claim 3 comprising the additional step of removing a bulk of the solids from the pyrolytic vapor mixture after separating the coarse fraction from the pyrolysis product stream and before condensing hydrocarbons from the pyrolytic vapor mixture.

9. A continuous process for recovery of values contained in a solid carbonaceous material comprising the steps of:

(a) introducing a feed stream comprising particulate solid carbonaceous material and a particulate heat source into a pyrolysis zone maintained at a temperature, by the flow of the particulate heat source through the pyrolysis zone, sufficient to pyrolize the particulate solid carbonaceous material to yield a pyrolysis product stream comprising, as solids, the particulate heat source and a carbon containing solid residue of pyrolysis, and a vapor mixture comprising volatilized hydrocarbons, and wherein the maximum particle size of the particulate solid carbonaceous material is between about 75 and about 1000 microns and is formed by comminuting the solid carbonaceous material to a size wherein a portion of the comminuted solid carbonaceous material is greater than the maximum particle size to minimize generation of fines, and by removing from the comminuted solid carbonaceous material particles greater than the maximum particle size and at least 10% by weight of fines less than about 10 microns in diameter;

(b) passing the pyrolysis product stream to a separation zone to separate a coarse fraction of the solids from the vapor mixture, and separating the coarse fraction of the solids from the vapor mixture, wherein the coarse fraction contains from about 50 to about 90% by weight of the fines in the pyrolysis product stream less than about 10 microns in diameter and then separating a bulk of the solids remaining in the vapor mixture from the vapor mixture;

(c) subjecting a carbon containing residue in at least a portion of the coarse fraction of the solids to at least partial oxidation in the presence of a source of oxygen to form the particulate heat source, and recycling the thusly formed particulate heat source to the pyrolysis zone; and (d) recovering hydrocarbon values by condensing volatilized hydrocarbons from the vapor mixture after separation of the bulk of the solids remaining in the vapor mixture.

10. A process as claimed in claim 9 wherein the coarse fraction contains from about 50 to about 80% by weight of the fines less than about 10 microns in diameter in the pyrolysis product stream.

11. A process as claimed in claim 9 comprising the additional step of removing a fines fraction from the particulate heat source prior to introducing the particulate heat source to the pyrolysis zone, wherein the fines fraction contains at least about 10% and up to about 50% by weight of fines less than about 10 microns in diameter present in the particulate heat source.

12. The process of claim 9 in which the solid carbonaceous material is an agglomerative coal and the agglomerative coal is prepared for pyrolysis by the steps of:

(a) initially comminuting to minimize generation of fines of agglomerative coal in a comminution stage so that a portion of the coal is larger than about 250 microns in diameter;

(b) separating oversize particles which are larger than about 250 microns in diameter from the comminuted coal and forming an oversize fraction and a feed stream comprising coal substantially free of such oversize particles for pyrolysis; and (c) recycling the separated oversize fraction to the comminution stage for further comminution.

13. A process as claimed in claim 11 wherein the fines fraction contains from about 20 to about 50% by weight of the fines less than about 10 microns in diameter in the particulate heat source.

14. A process as claimed in claim 11 including the step of separating a solid product comprising solids from the pyrolysis product stream.

15. A continuous process for recovery of values contained in solid carbonaceous materials which comprises, in combination, the steps of:

(a) introducing particulate solid carbonaceous material having a maximum diameter between about 75 microns and about 1000 microns and formed by comminuting solid carbonaceous material to a size wherein a portion of the comminuted material is of a diameter greater than the maximum diameter to minimize formation of fines, removing particles having a diameter greater than the maximum diameter and removing at least 10% by weight of fines less than about 10 microns in diameter and a particulate heat source into a pyrolysis zone maintained at a temperature sufficient to pyrolyze the particulate solid carbonaceous material to yield by the flow of the particulate heat source through the pyrolysis zone a pyrolysis product stream comprising, as solids, the particulate heat source and a carbon containing solid residue of pyrolysis, and a vapor mixture comprising volatilized hydrocarbons;

(b) separating solids from the pyrolysis product stream and subjecting at least a portion of the carbon containing solid residue in the separated solids to at least partial oxidation in the presence of a source of oxygen to form a hot solids stream;

(c) separating a fines fraction and a coarse fraction from the hot solids stream, and recycling the coarse fraction to the pyrolysis zone as the particulate heat source, and wherein the fines fraction contains at least about 10% and up to about 50% by weight of fines less than 10 microns in diameter in the hot solids stream; and (d) separating and recovering values from the vapor mixture by condensing volatilized hydrocarbons therefrom.

16. A process as claimed in claim 15 wherein the fines fraction contains from about 20 to about 50% by weight of fines less than about 10 microns in diameter in the hot solids stream.

17. A continuous process for recovery of values contained in an agglomerative coal which comprises, in combination, the steps of:

(a) preparing a coal feed stream for pyrolysis by:

(i) initially comminuting agglomerative coal in a comminution stage so that a portion of the coal is larger than about 250 microns in diameter;

(ii) separating from about 20 to about 50% by weight of fines less than about 10 microns in diameter from the comminuted agglomerative coal;

(iii) separating oversize particles which are greater than about 250 microns from the comminuted agglomerative coal, and forming an oversize fraction and a coal feed stream substantially free of such oversize particles for pyrolysis; and (iv) recycling the separated oversize fraction to the comminution stage for further comminution;

(b) subjecting the coal feed stream to pyrolysis by introducing the coal feed stream and a particulate heat source comprising particulate char into a pyrolysis zone maintained at a temperature sufficient to yield by pyrolysis of the agglomerative coal a pyrolysis product stream comprising char and a vapor mixture comprising volatilized hydrocarbons;

(c) passing the pyrolysis product stream to a separation zone to separate a coarse fraction of the char from the vapor mixture, separating the coarse fraction of the char from the vapor mixture, wherein the coarse fraction contains from about 50 to about 80% by weight of the char fines less than about 10 microns in diameter present in the pyrolysis product stream, and then separating a bulk of the solids remaining in the vapor mixture from the vapor mixture;

(d) subjecting at least a portion of the separated coarse char fraction to at least partial oxidation in the presence of a source of oxygen to form hot char;

(e) removing a fines fraction from the hot char, thereby leaving a coarse fraction, and recycling the coarse fraction as the particulate heat source for introduction into the pyrolysis zone, wherein the fines fraction contains from about 20 to about 50% by weight of fines less than about 10 microns in diameter in the hot char; and (f) separating and recovering values from the vapor mixture by condensing hydrocarbons therefrom after separation of the bulk of the solids remaining in the vapor mixture.

18. A process as claimed in claim 17 including the step of collecting a solid product comprising particulate char in the pyrolysis product stream.

19. A continuous process for recovery of values contained in an agglomerative coal which comprises, in combination, the steps of:

(a) preparing agglomerative coal for pyrolysis by forming a coal feed stream by the steps of:

(i) initially comminuting agglomerative coal in a comminution stage so that a portion of the agglomerative coal is larger than about 250 microns in diameter to minimize generation of fines;

(ii) separating oversize agglomerative coal particles which are larger than about 250 microns in diameter from the comminuted agglomerative coal and forming an oversize fraction and a coal feed stream substantially free of such oversize agglomerative coal particles for pyrolysis;

(iii) recycling the separated oversize fraction to the comminution stage for further comminution to a size less than about 250 microns in diameter; and (iv) separating from the agglomerative coal feed stream at least 10% by weight of fines less than about 10 microns in diameter;

(b) subjecting the agglomerative coal feed stream having at least 10% by weight of the fines less than about 10 microns in diameter removed, to pyrolysis by introducing the agglomerative coal feed stream and a particulate heat source comprising particulate char into a pyrolysis zone maintained at a temperature sufficient to yield by pyrolysis of the agglomerative coal, a pyrolysis product stream comprising char and a pyrolytic vapor mixture comprising volatilized hydrocarbons;

(c) passing the pyrolysis product stream to a separation zone to separate char from the pyrolytic vapor mixture and separating char from the pyrolytic vapor mixture;

(d) subjecting at least a portion of the separated char to at least partial oxidation in the presence of a source of oxygen to form the particulate heat source, and recycling the thusly formed particulate heat source to the pyrolysis zone; and (e) separating and recovering values from the pyrolytic vapor mixture by condensing hydrocarbons therefrom.

20. A process as claimed in claim 14 in which a mass of fines removed from the particulate heat source in combination with a mass of the solids in the pyrolysis product stream not separated as a portion of the coarse fraction is about equal to the mass of solid product collected and removed from the process.

21. A process as claimed in claim 18 in which a mass of fines separated from the hot char in combination with a mass of fines not separated as a portion of the coarse fraction from the pyrolysis product stream are about equal to a mass of the solid product collected and removed from the process.

22. A continuous process for producing liquid hydrocarbon values from carbonaceous material comprising:

(a) comminuting, to minimize generation of fines, a carbonaceous material in a comminution stage so that the comminuted carbonaceous material comprises particles larger than a predetermined particle size, the predetermined particle size being between about 75 microns and about 1000 microns;

(b) separating the comminuted carbonaceous material into an oversize fraction which comprises essentially all of the particles which are larger than the predetermined particle size, and a feed fraction which contains particles all of which are essentially smaller than about the predetermined particle size;

(c) recycling the oversize fraction to the comminution stage and comminuting said oversize fraction therein;

(d) separating from the feed fraction at least 10% by weight of particles present in the feed fraction which are less than about 10 microns in diameter;

(e) introducing the feed fraction, having at least 10% by weight of the particles less than about 10 microns in diameter removed, a particulate heat source, and a transport gas into a pyrolysis zone, heating the feed fraction with the particulate heat source in the pyrolysis zone to produce a pyrolysis product stream comprising a solid pyrolyzate and a vapor mixture, wherein the solid pyrolyzate comprises a carbon containing residue of the feed fraction and the particulate heat source, wherein the vapor mixture comprises volatilized hydrocarbons produced from pyrolysis of the feed fraction and the transport gas, and wherein the pyrolysis product stream also comprises fines less than about 10 microns in diameter;

(f) removing the pyrolysis product stream from the pyrolysis zone and introducing the pyrolysis product stream into a first separation zone, and separating the pyrolysis product stream into a coarse pyrolyzate comprising about 50 to about 90% by weight of the fines in the pyrolysis product stream and a remainder pyrolysis product stream;

(g) introducing the remainder pyrolysis product stream into a second separation zone, and separating the remainder pyrolysis product stream into a fine pyrolyzate and a gaseous stream of low solid content comprising the volatilized hydrocarbons and the transport gas;

(h) separating and recovering liquid hydrocarbon values from the gaseous stream by condensing volatilized hydrocarbons therefrom;

(i) introducing the separated coarse pyrolyzate and oxygen to an oxidation zone to produce an oxidation product stream comprising hot solids and a flue gas, and wherein the oxidation product stream also comprises fines less than about 10 microns in diameter;

(j) introducing the oxidation product stream into a third separation zone and separating the oxidation product stream into a coarse oxidation fraction comprising about 50 to about 90% by weight of the fines of the oxidation product stream, and a remainder oxidation product stream; and (k) recycling the coarse oxidation fraction to the pyrolysis zone as the particulate heat source.

23. The process of claim 22 further comprising separating from about 20 to about 50% by weight of fines less than about 10 microns in diameter from the comminuted carbonaceous material before it is introduced into the pyrolysis zone.

24. The process of claim 22 further comprising introducing the remainder oxidation product stream into a fourth separation zone and separating solids from the flue gas, and recovering the solids thusly separated and the fine pyrolyzate as solid product.

25. The process of claim 22 further comprising recovering a gas from the gaseous stream after condensing volatilized hydrocarbons therefrom, and recycling the gas to the pyrolysis zone as the transport gas.

26. The process of claim 22 wherein the carbonaceous material is coal and the predetermined particle size is about 250 microns.

27. The process of claim 26 wherein the coarse pyrolyzate comprises about 50 to about 80% by weight of the fines of the pyrolysis product stream.

28. The process of claim 26 wherein the coarse oxidation fraction comprises about 50 to about 80% by weight of the fines of the oxidation product stream.

29. The process of claim 26 wherein the coarse pyrolyzate comprises about 50 to about 80% by weight of the fines in the pyrolysis product stream, and the coarse oxidation fraction comprises about 50 to about 80% by weight of the fines of the oxidation product stream.

30. A continuous process for producing liquid hydrocarbon values from agglomerative coal comprising:

(a) comminuting an agglomerative coal in a comminution stage so that the comminuted agglomerative coal comprises particles larger than about 250 microns in diameter to minimize generation of fines;

(b) separating the comminuted agglomerative coal into an oversize fraction which comprises essentially all of the agglomerative coal particles which are larger than about 250 microns in diameter, and a feed fraction which contains agglomerative coal particles, all of which are essentially smaller than about 250 microns in diameter;

(c) recycling the oversize fraction to the comminution stage and comminuting said oversize fraction therein;

(d) removing from the feed fraction at least 10% by weight of particles which are less than about 10 microns in diameter;

(e) introducing the feed fraction, having at least 10% by weight of the particles less than about 10 microns in diameter removed, a particulate heat source, and a transport gas into a pyrolysis zone, heating the feed fraction with the particulate heat source in the pyrolysis zone to produce a pyrolysis product stream comprising a solid pyrolyzate and a vapor mixture, wherein the solid pyrolyzate comprises a carbon containing residue of the feed fraction and the particulate heat source, wherein the vapor mixture comprises volatilized hydrocarbons produced from pyrolysis of the feed fraction and the transport gas, and wherein the pyrolysis product stream also comprises fines less than about 10 microns in diameter;

(f) removing the pyrolysis product stream from the pyrolysis zone and introducing the pyrolysis product stream into a first separation zone, and separating the pyrolysis product stream into a coarse pyrolyzate comprising about 50 to about 90% by weight of the fines in the pyrolysis product stream and a remainder pyrolysis product stream;

(g) introducing the remainder pyrolysis product stream into a second separation zone, and separating the remainder pyrolysis product stream into a fine pyrolyzate and a gaseous stream of low solid content comprising the volatilized hydrocarbons and the transport gas;

(h) separating and recovering liquid hydrocarbon values from the gaseous stream by condensing volatilized hydrocarbons therefrom;

(i) introducing the separated coarse pyrolyzate and oxygen to an oxidation zone to produce an oxidation product stream comprising hot solids and a flue gas, and wherein the oxidation product stream also comprises fines less than about 10 microns in diameter;

(j) introducing the oxidation product stream into a third separation zone and separating the oxidation product stream into a coarse oxidation fraction comprising about 50 to about 90% by weight of the fines of the oxidation product stream, and a remainder oxidation product stream; and (k) recycling the coarse oxidation fraction to the pyrolysis zone as the particulate heat source.

31. The process of claim 30 wherein the coarse pyrolyzate comprises about 50 to about 80% by weight of the fines of the pyrolysis product stream.

32. The process of claim 30 wherein the coarse oxidation fraction comprises about 50 to about 80% by weight of the fines of the oxidation product stream.

33. The process of claim 30 wherein the coarse pyrolyzate comprises about 50 to about 80% by weight of the fines in the pyrolysis product stream, and the coarse oxidation fraction comprises about 50 to about 80% by weight of the fines of the oxidation product stream.

34. The process of claim 30 further in which from about 20 to about 50% by weight of fines less than about 10 microns in diameter are separated from the agglomerative coal before it is introduced into the pyrolysis zone.

* * * * *

UNITED STATES PATENT AND TRADEMARK OFFICE

CERTIFICATE OF CORRECTION

PATENT NO. : 4,263,124

DATED : April 21, 1981

INVENTOR(S) : Gary H. Wickstrom et al

It is certified that error appears in the above—identified patent and that said Letters Patent is hereby corrected as shown below:

Column 6, lines 1 & 2, "commuting" should be -- comminuting --.
Column 6, line 3, "This" should be -- That --.
Column 8, line 6, "is" should be -- are --.
Column 10, line 45, "is" should be -- are --.
Column 11, line 34, "the" should be -- a --.
Column 15, line 65, after "of" and before "solid", insert -- a --.

Signed and Sealed this

*Thirteenth* Day of *July 1982*

[SEAL]

*Attest:*

GERALD J. MOSSINGHOFF

*Attesting Officer*

*Commissioner of Patents and Trademarks*